US005908196A

United States Patent [19]

Weiss

[11] Patent Number: 5,908,196

[45] Date of Patent: Jun. 1, 1999

[54] APPARATUS FOR ROLLER SKATING AND ROLLER BLADING AND METHOD THEREOF

[76] Inventor: Joshua L. Weiss, 49 Biltmore Estates, Phoenix, Ariz. 85016

[21] Appl. No.: 08/926,298

[22] Filed: Sep. 5, 1997

Related U.S. Application Data

[63] Continuation of application No. 08/517,575, Aug. 21, 1995, abandoned.

[51] Int. Cl.[6] ..... A63C 17/00

[52] U.S. Cl. ..... 280/11.19; 280/7.13; 280/9; 280/11; 280/11.22; 280/11.27; 280/43.13

[58] Field of Search ..... 280/11.19, 11.22, 280/11.23, 11.26, 11.27, 7.1, 9, 841, 43.13, 43.17, 11, 7.13, 842

[56] References Cited

U.S. PATENT DOCUMENTS

| | | | |
|---|---|---|---|
| 153,945 | 8/1874 | Gregg | 280/11.19 |
| 954,993 | 4/1910 | Peters | 280/11.19 |
| 5,224,718 | 7/1993 | Gertler | 280/11.19 |
| 5,295,701 | 3/1994 | Reiber et al. | 280/11.22 |
| 5,449,183 | 9/1995 | Klamer et al. | 280/11.27 |
| 5,494,304 | 2/1996 | Levy et al. | 280/11.22 |
| 5,524,911 | 6/1996 | Cochimin | 280/7.1 |

FOREIGN PATENT DOCUMENTS

| | | | |
|---|---|---|---|
| 143742 | 2/1931 | Switzerland | 280/841 |
| 176382 | 6/1935 | Switzerland | 280/841 |

*Primary Examiner*—Eric D. Culbreth
*Attorney, Agent, or Firm*—Harry M. Weiss; Jeffrey D. Moy; Harry M. Weiss & Associates, Inc.

[57] ABSTRACT

A shoe type apparatus is disclosed comprising a roller skate assembly having at least four wheels coupled to a sole portion of the shoe type apparatus for roller skating, and an in-line skate assembly having another set of wheels coupled to the sole portion for in-line skating. The shoe type apparatus provides at least three distinct configurations of the roller skate and in-line skate assemblies, namely having the wheels of the roller skate assembly lower than, level with, or higher than the wheels of the in-line skate assembly. This flexible arrangement permits a user to roller skate, to roller blade, or to perform a new combination thereof.

29 Claims, 2 Drawing Sheets

APPARATUS FOR ROLLER SKATING AND ROLLER BLADING AND METHOD THEREOF

This is a continuation of application Ser. No. 08/517,575 filed on Aug. 21, 1995, now abandoned.

BACKGROUND OF THE INVENTION

1. Field of the Invention

This invention relates generally to an apparatus and method for skating and, more specifically, to an apparatus and method that may be selectively used for roller skating, in-line skating, or a combination thereof.

2. Description of the Related Art

Roller skates and in-line skates (commonly referred to as "roller blades") are popular for exercise and amusement. As commonly used, the term roller skate refers to a shoe type skate having four wheels along two longitudinal axes, with two wheels at the front and two at the back. The term in-line skate refers to a shoe type skate, typically of four wheels, in which all the wheels are arranged in tandem along a longitudinal axis.

Though both roller skates and in-line skates are forms of foot transportation devices using wheels, each provides a unique experience to the skater. Further, compared to in-line skates, roller skates are sometimes easy to learn and less strenuous to use. On the other hand, a skater can move faster on in-line skates. Since the experiences that a user gets from roller skating and in-line skating are varied, a skater is bound to be deprived of some enjoyment if he/she does not own both roller skates and in-line skates.

Some modified skates are presently known in the art. The Reiber et al. patent (U.S. Pat. No. 5,295,701) shows an in-line skate assembly having training wheels. It shows an in-line skate assembly having longitudinally aligned front and rear rollers. A center roller, which is mounted between the front and rear rollers, is alternatively positionable in a longitudinally aligned position relative to the front and rear rollers or a transversely offset position relative thereto. However, the Reiber patent fails to disclose a skating apparatus that is a roller skate either in appearance or in experience. Stability, the key advantage of a roller skate, is absent in the Reiber patent. Indeed, a skating apparatus that provides both an in-line skating assembly and a roller skating assembly and which has both assemblies functional at the same time would provide maximum stability.

The Gertler patent (U.S. Pat. No. 5,224,718) shows a foot transport device for fastening to a foot. The device has an in-line skate assembly and a removable stabilizer. The removable stabilizer, which protrudes laterally outward of the wheels, is arranged on either side of the in-line skate assembly to allow the unskilled to learn how to use the device. Though the Gertler patent suggests that wheels may be used as a stabilizer, such wheels are to be of a size smaller than those of the in-line skate assembly. Further, the Gertler patent does not disclose a roller skate assembly or how the device may be used as a roller skate.

Therefore, there existed a need to provide an apparatus with both a roller skate assembly and an in-line skate assembly such that the apparatus could be used either as a roller skate or as an in-line skate. A further need existed to provide an apparatus with both the roller skate assembly and the in-line skate assembly such that either the roller skate assembly or the in-line skate assembly could be retracted or extended.

SUMMARY OF THE INVENTION

In accordance with one embodiment of this invention, it is an object of this invention to provide an improved shoe type apparatus for skating and methods therefor.

It is another object of this invention to provide an improved shoe type apparatus that can be used selectively as a roller skate, as an in-line skate, or as a combination thereof, and methods therefor.

It is another object of this invention to provide an improved shoe type apparatus having a retractable in-line skating assembly and methods therefor.

BRIEF DESCRIPTION OF THE PREFERRED EMBODIMENTS

In accordance with one embodiment of this invention, a shoe type apparatus is disclosed comprising, in combination, roller skate means comprising at least four wheels coupled to a sole portion of the shoe type apparatus for roller skating, and in-line skate means comprising another set of wheels coupled to the sole portion of the shoe type apparatus for in-line skating. The roller skate means comprises a plurality of axles, roller skate mounting means for securing each axle of the plurality of axles substantially perpendicular to a lengthwise axis of the sole portion, and means for rotatably coupling each wheel of the at least four wheels to a corresponding axle of the plurality of axles. The roller skate mounting means comprises first member means vertically coupled to the sole portion for engaging an end of one of the plurality of axles, and second member means vertically coupled to the sole portion for engaging an opposite end of the selected axle such that the axle is suspended horizontally between the first and second member means.

The in-line skate means comprises a plurality of axles coupled to the sole portion and arranged in tandem along a longitudinal axis substantially bisecting the sole portion, in-line skate mounting means for securing each axle of the plurality of axles substantially perpendicular to the longitudinal axis of the sole portion, and means for rotatably coupling each wheel of the other set of wheels to a corresponding axle of the plurality of axles. The in-line skate mounting means comprises first member means vertically coupled to the sole portion for engaging an end of one of the plurality of axles, and second member means vertically coupled to the sole portion for engaging an opposite end of the selected axle such that the axle is suspended horizontally between the first and second member means. Additionally, the shoe type apparatus includes in-line skate positioning means for extending and retracting the in-line skate means in relation to the sole portion. The in-line skate positioning means comprises at least one horizontal member rotatably coupled to each axle of the plurality of axles, at least one vertical member having an extended shaft portion rotatably coupled to each of the first and second member means, and locking means coupled to each of the first and second member means and comprising a locking shaft for insertion into any one of a plurality of apertures in the vertical member and for locking therein to hold the in-line skate means in any one of a plurality of configurations. Note that the plurality of configurations includes at least a first configuration whereby the wheels for in-line skating are lower than the wheels for roller skating, a second configuration whereby the wheels for in-line skating are level with the wheels for roller skating, and a third configuration whereby the wheels for in-line skating are higher than the wheels for roller skating. The shoe type apparatus further comprises braking means for slowing or stopping a user of the shoe type apparatus.

In accordance with another embodiment of this invention, a method of operating a shoe type apparatus is disclosed comprising the steps of coupling roller skate means comprising at least four wheels to a sole portion of the shoe type apparatus for roller skating, and coupling in-line skate means comprising another set of wheels to the sole portion for in-line skating.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
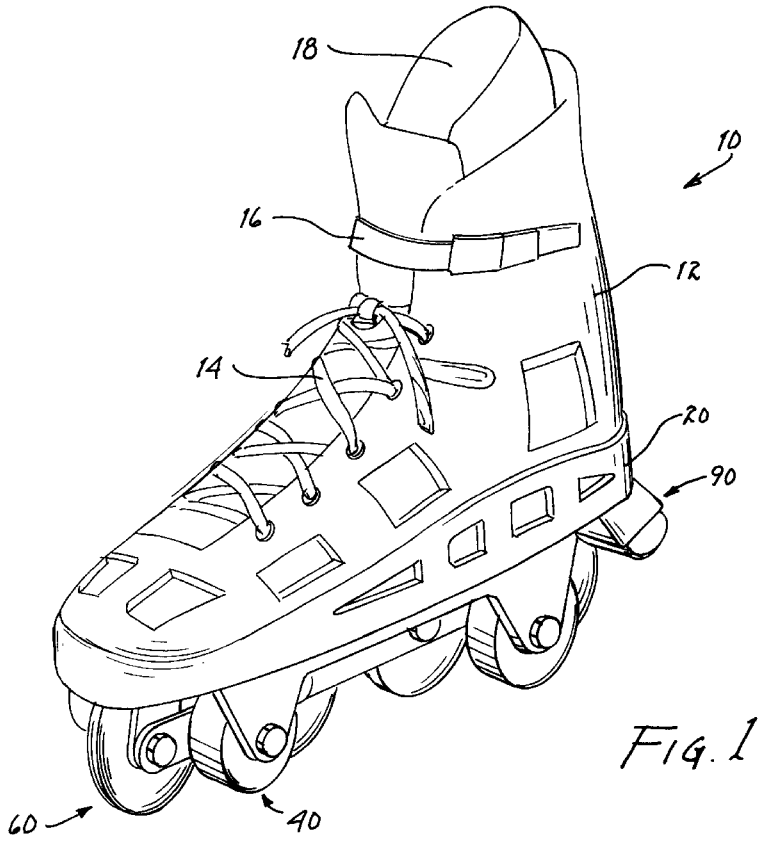
FIG. 1 is a perspective view of a shoe type apparatus according to the present invention.

FIG. 1 depicts a shoe type apparatus 10 for skating. The apparatus 10 comprises an upper shoe 12 and a sole portion 20. An opening 18 is provided on the upper shoe 12 to insert a user's foot (not shown). A lace 14 and a strap 16 are provided on the upper shoe 12 for securing the foot inside the apparatus 10. Note, the lace 14 and the strap 16 may be replaced or supplemented by other forms of fastening devices well known in the art.

To the sole underside 22 (see FIG. 2) are coupled roller skating assemblies 40, in-line skating assemblies 60, and a brake assembly 90. Each of these is described in greater detail hereinafter.

Figure 2:
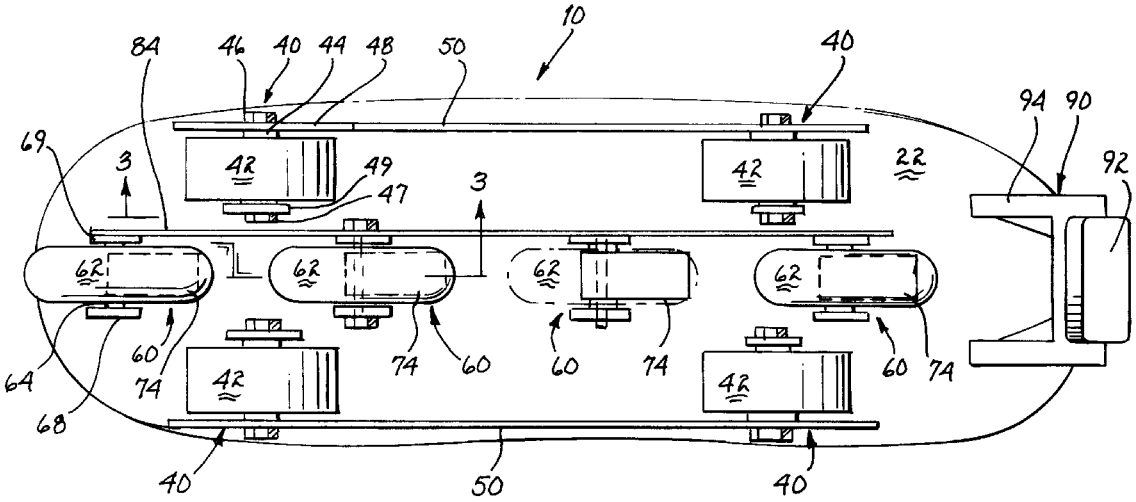
FIG. 2 is a bottom view of the shoe type apparatus in FIG. 1.

FIG. 2 is a bottom view of the shoe type apparatus 10 showing the sole underside 22. The four similar roller skating assemblies 40 enable a user to roller skate. Two of the roller skating assemblies 40 are placed toward the front of the shoe type apparatus 10, one on either side of a longitudinal axis bisecting the sole underside 22. Two other roller skating assemblies 40 are similarly placed toward the rear.

The structure of a roller skating assembly 40 is described below. Each roller skating assembly 40 supports a roller wheel 42. An axle 44 is suspended between two vertical members 48 and 49 such that the axle 44 is perpendicular to a longitudinal axis of the sole underside 22. The vertical member 49 is on the inner side of the wheel 42, and the vertical member 48 is on the outer side. Two longitudinally placed braces 50 strengthen the roller skate mechanisms 40. One end of each brace 50 is coupled to a vertical member 48 and the opposite end is coupled to another vertical member 48 longitudinally aligned with the first.

Figure 4:
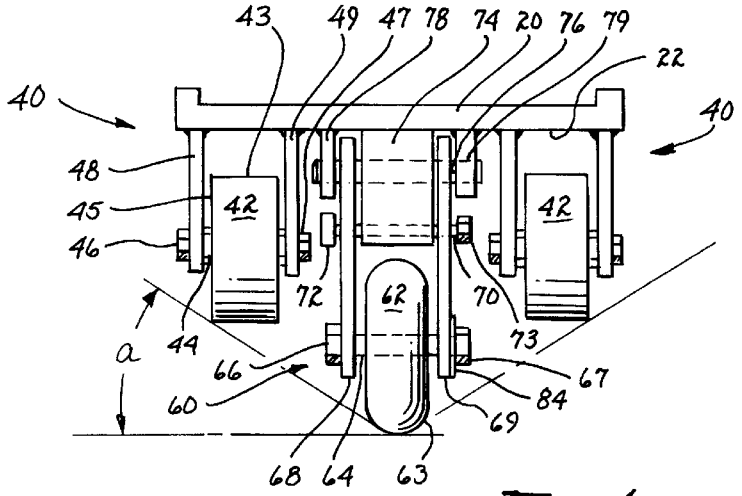
FIG. 4 is a cross-sectional view of the shoe type apparatus, taken along line 4—4 of FIG. 3, showing a portion of the roller skating assembly and in-line skating assembly.

FIG. 4 shows the roller skating assembly 40 in greater detail. The roller wheel 42 is rotatably mounted with the axle 44 using any one of several means well known in the art. In the preferred embodiment and in keeping with the practice of the art, the running surface 43 of the roller wheel 42 is substantially flat and perpendicular to the sides 45 of the roller wheel 42. The coupling between the axle 44 and the vertical members 48 and 49 is secured by means of nuts 46 and 47. One end of each vertical member 48 and 49 is anchored to the sole underside 22. Note that spacers (not shown) may be provided between the inner sides of any wheel 42 and the vertical members 48 and 49 in order to limit lateral movement of the wheel 42.

Referring to FIG. 2 again, in the preferred embodiment four similar in-line skating assemblies 60 enable a user to in-line skate. Note, the shoe type apparatus 10 may be designed with more or fewer in-line skating assemblies 60 than the four indicated in the preferred embodiment. The in-line skating assemblies 60 are arranged in tandem along a longitudinal axis substantially bisecting the sole underside 22. Each in-line skating assembly 60 supports an in-line wheel 62. An axle 64 is suspended between two vertical members 68 and 69, such that the axle 64 is perpendicular to the longitudinal axis of the sole underside 22.

FIG. 4 shows the in-line skating assembly in greater detail. The in-line wheel 62 is rotatably mounted with the axle 64 using any one of several means well known in the art. In the preferred embodiment and in keeping with the practice of the art, the running surface 63 of the in-line wheel 62 is curved. The coupling between the axle 64 and the vertical members 68 and 69 is secured by means of nuts 66 and 67. One end of each vertical member 68 and 69 is rotatably coupled to a shaft 76, such that a hinge is formed. The shaft 76 is suspended between two short vertical structures 78 and 79. The vertical structures 78 and 79 are coupled to the sole underside 22. A vertical member 74, located between the vertical structures 78 and 79, is also coupled to the sole underside 22. Thus, the shaft 76 passes through the vertical structures 68, 69 and 74.

Figure 3:
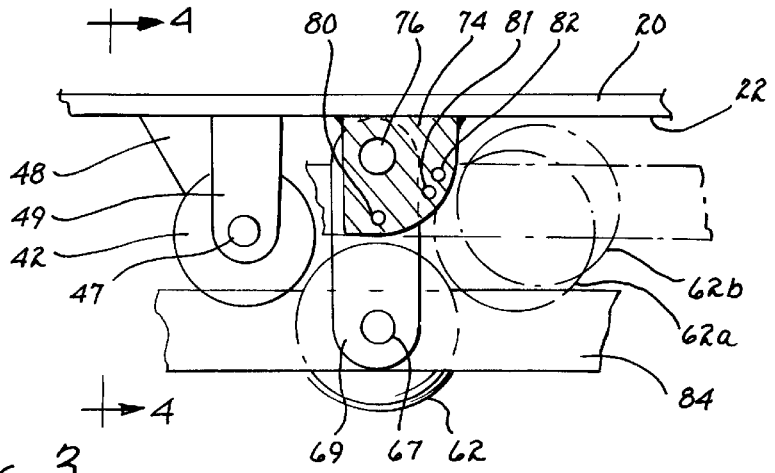
FIG. 3 is a cross-sectional view of the shoe type apparatus, taken along line 3—3 of FIG. 2, showing a portion of the roller skating assembly and in-line skating assembly. Note that one of the wheels of the in-line skating assembly is shown in an extended position, and also shown in phantom, as being retracted.
Figure 5:
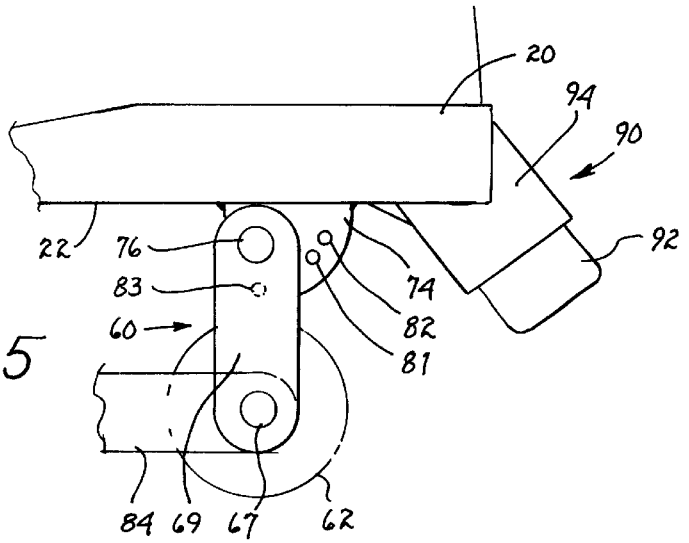
FIG. 5 is a side view of the rear of the shoe type apparatus showing a portion of the in-line skating assembly and the brake.

FIGS. 3 and 5 depict more clearly the positioning mechanism of the in-line assembly 60. Referring to FIG. 3, the vertical member 74 has three apertures 80, 81 and 82 placed along an arc centered around the shaft 76. The vertical member 69 has a complementary hole 83 (see FIG. 5) so located that, when the vertical member 69 is swung about the shaft 76, the complementary hole 83 may be selectively aligned with the apertures 80, 81 and 82. A similar complementary hole (not shown, but see FIG. 4) is also provided on the vertical member 68. Since the two vertical members 68 and 69 are hinged on shaft 76 at one end, and coupled to axle 64 at the other, the complementary holes 83 on the two vertical members 68 and 69 will always be aligned with one another. Referring back to FIG. 4, a locking shaft 70 is used to lock the vertical members 68 and 69 in one of three positions in which the holes 83 are aligned with one of the apertures 80, 81, and 82. The shaft head 73 and the nut 72 prevent the locking shaft 70 from accidentally slipping out. Note that more or less than three apertures could be provided in vertical member 74.

Referring again to FIG. 2, a horizontal member 84 is coupled to one end of the axles 64. This horizontal member 84 not only strengthens the in-line skating assemblies 60, but also assists in positioning the in-line assemblies 60. Further, an alternate embodiment (not shown) could be provided wherein not all the in-line skating assemblies 60 have a positioning mechanism. In such an embodiment, in those in-line skating assemblies 60 without the positioning mechanism, the vertical members 68 and 69 would be free to swing on the hinge formed with the shaft 76. Because all of the in-line skating assemblies are mechanically coupled together via horizontal member 84, when the in-line assemblies 60 with the positioning mechanism are locked into one of the three positions, the horizontal member 84 would force the in-line assemblies 60 without the positioning mechanism to move correspondingly.

The brake assembly 90 is depicted in FIG. 2. In the preferred embodiment, the brake assembly 90 is located toward the rear of the shoe type apparatus 10. Note the brake assembly 90 may also be located toward the front of the shoe type apparatus 10. The design of the brake assembly 90 is depicted more clearly in FIG. 5. The brake pad 92 is set on a support 94 and the support 94 is to the rear of the sole underside 22. FIGS. 1 and 5 show placement of the brake assembly 90 on the sole 20. The brake assembly 90 is set at the very rear of the shoe type apparatus 10 and at an obtuse angle relative to the sole underside 22.

OPERATION

The present invention will allow a user to selectively roller skate, in-line skate, or combination skate (i.e. skate with both the roller skate and in-line skate wheels functional) without having to use different apparatus for each purpose. The techniques for skating using wheels is well known in the art. The foot (not shown) of the user is inserted into the shoe type apparatus 10 through the opening 18 and secured with the laces 14 and strap 16.

The user can selectively use the shoe type apparatus 10 for roller skating, in-line skating, and combination skating by changing the position of the in-line skating assemblies 60. Referring to FIGS. 3 and 5, when the hole 83 is aligned against aperture 80, the in-line wheels 62 are at their lowest position, which is lower than the roller wheels 42. When all the in-line wheels 62 are at their lowest position, only the in-line wheels 62 are functional, and the shoe type apparatus 10 functions as an in-line skate. When the hole 83 is aligned against aperture 82, the in-line wheels 62 are at their highest position (see FIG. 3, 62*b*), which is higher than the roller wheels 42. When all the in-line wheels 62 are at their highest position, only the roller wheels 42 are functional, and the shoe type apparatus 10 functions as a roller skate. When the hole 83 is aligned against aperture 81, the in-line wheels 62 are level with the roller wheels 42 (see FIG. 3, 62*a*). When the in-lines wheels 62 are in this position, both the in-line wheels 62 and roller wheels 42 are functional, and the shoe type apparatus 10 functions as a combination skate.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. A shoe apparatus comprising, in combination:

roller skate means consisting of only four roller skate wheels coupled to a sole portion of said shoe apparatus for roller skating only; and in-line skate means consisting of another narrower in width relative to said roller skate wheels set of in-line skate wheels coupled to said sole portion for in line skating only.

2. The apparatus of claim 1 wherein said roller skate means comprises:

a plurality of axles;

roller skate mounting means for securing each axle of said plurality of axles substantially perpendicular to a lengthwise axis of said sole portion; and means for rotatably coupling each wheel of said four wheels to a corresponding axle of said plurality of axles.

3. The apparatus of claim 2 wherein a first pair of wheels of said four wheels is positioned toward a front portion of said sole portion, said first pair of wheels being located on opposite sides of a longitudinal axis bisecting said sole portion, and wherein a second pair of wheels of said four wheels is positioned toward a rear portion of said sole portion, said second pair of wheels being located on opposite sides of said longitudinal axis bisecting said sole portion.

4. The apparatus of claim 2 wherein said roller skate mounting means comprises:

first member means vertically coupled to said sole portion for engaging an end of one of said plurality of axles; and second member means vertically coupled to said sole portion for engaging an opposite end of said one of said plurality of axles such that said one of said plurality of axles is suspended horizontally between said first and said second member means.

5. The apparatus of claim 1 wherein said in-line skate means comprises:

a plurality of axles coupled to said sole portion and arranged in tandem along a longitudinal axis substantially bisecting said sole portion;

in-line skate mounting means for securing each axle of said plurality of axles substantially perpendicular to said longitudinal axis of said sole portion; and means for rotatably coupling each wheel of said another set of wheels to a corresponding axle of said plurality of axles.

6. The apparatus of claim 5 wherein said in-line skate mounting means comprises:

first member means vertically coupled to said sole portion for engaging an end of one of said plurality of axles; and second member means vertically coupled to said sole portion for engaging an opposite end of said one of said plurality of axles such that said one of said plurality of axles is suspended horizontally between said first and said second member means.

7. The apparatus of claim 1 wherein at least one of said roller skate means and said in-line skate means is vertically extended and retracted in relation to said sole portion.

8. The apparatus of claim 7 wherein only one of said roller skate means and said in-line skate means is vertically extended and retracted in relation to said sole portion.

9. The apparatus of claim 8 wherein only said in-line skate means is vertically extended and retracted in relation to said sole portion.

10. The apparatus of claim 9 further comprising in-line skate positioning means for vertically extending and retracting said in-line skate means in relation to said sole portion.

11. The apparatus of claim 1 further comprising braking means coupled to said sole portion of said shoe apparatus for slowing down a user of said shoe apparatus.

12. A shoe apparatus comprising, in combination:

roller skate means comprising at least four wheels coupled to a sole portion of said shoe apparatus for roller skating; and in-line skate means comprising another set of wheels coupled to said sole portion for in-line skating, said in-line skate means comprising:

a plurality of axles coupled to said sole portion and arranged in tandem along a longitudinal axis substantially bisecting said sole portion;

in-line skate mounting means for securing each axles of said plurality of axles substantially perpendicular to said longitudinal axis of said sole portion; and means for rotatable coupling each wheel of said another set of wheels to a corresponding axle of said plurality of axles, said in-line skate mounting means comprising:

first member means vertically coupled to said sole portion for engaging an end of one of said plurality of axles; and second member means vertically coupled to said sole portion for engaging an opposite end of said one of said plurality of axles such that said one of said plurality of axles is suspended horizontally between said first and said second member means, further comprising in-line skate positioning means for extending and retracting said in-line skate means in relation to said sole portion.

13. The apparatus of claim 12 wherein said in-line skate positioning means comprises:

at least one horizontal member rotatably coupled to each axle of said plurality of axles;

at least one vertical member having an extended shaft portion rotatably coupled to each of said first and said second member means; and locking means coupled to each of said first and said second member means and comprising a locking shaft for insertion into any one of a plurality of apertures in said at least one vertical member and for locking therein to hold said in-line skate means in any one of a plurality of configurations.

14. The apparatus of claim 13 wherein said plurality of configurations comprises at least a first configuration whereby said another set of wheels is lower than said four wheels, a second configuration whereby said another set of wheels is level with said four wheels, and a third configuration whereby said another set of wheels is higher than said four wheels.

15. A method of making a shoe apparatus comprising the steps of:

coupling roller skate means consisting of only four roller skate wheels to a sole portion of said shoe apparatus for roller skating only; and coupling in-line skate means consisting of another narrower in width relative to said roller skate wheels set of in-line skate coupled to said sole portion for in-line skating only.

16. The method of claim 15 wherein said step of coupling roller skate means includes the steps of:

providing a plurality of axles;

providing roller skate mounting means for securing each axle of said plurality of axles substantially perpendicular to a lengthwise axis of said sole portion; and providing means for rotatably coupling each wheel of said four wheels to a corresponding axle of said plurality of axles.

17. The method of claim 16 further including the steps of:

positioning a first pair of wheels of said four wheels toward a front portion of said sole portion, said first pair of wheels being located on opposite sides of a longitudinal axis bisecting said sole portion; and positioning a second pair of wheels of said four wheels toward a rear portion of said sole portion, said second pair of wheels being located on opposite sides of said longitudinal axis bisecting said sole portion.

18. The method of claim 16 wherein said step of providing roller skate mounting means includes the steps of:

vertically coupling first member means to said sole portion for engaging an end of one of said plurality of axles; and vertically coupling second member means to said sole portion for engaging an opposite end of said one of said plurality of axles such that said one of said plurality of axles is suspended horizontally between said first and said second member means.

19. The method of claim 15 wherein said step of coupling in-line skate means includes the steps of:

providing a plurality of axles coupled to said sole portion and arranged in tandem along a longitudinal axis substantially bisecting said sole portion;

providing in-line skate mounting means for securing each axle of said plurality of axles substantially perpendicular to said longitudinal axis of said sole portion; and providing means for rotatably coupling each wheel of said another set of wheels to a corresponding axle of said plurality of axles.

20. The method of claim 19 wherein said step of providing in-line skate mounting means includes the steps of:

vertically coupling first member means to said sole portion for engaging an end of one of said plurality of axles; and vertically coupling second member means to said sole portion for engaging an opposite end of said one of said plurality of axles such that said one of said plurality of axles is suspended horizontally between said first and said second member means.

21. The method of claim 15 wherein at least one of said roller skate means and said in-line skate means is vertically extended and retracted in relation to said sole portion.

22. The method of claim 21 wherein only one of said roller skate means and said in-line skate means is vertically extended and retracted in relation to said sole portion.

23. The method of claim 22 wherein only said in-line skate means is vertically extended and retracted in relation to said sole portion.

24. The method of claim 23 further comprising in-line skate positioning means for vertically extending and retracting said in-line skate means in relation to said sole portion.

25. The method of claim 15 further including the step of providing braking means for slowing or stopping a user of said shoe apparatus.

26. A method of making a shoe apparatus comprising the steps of:

coupling roller skate means comprising at least four wheels to a sole portion of said shoe apparatus for roller skating; and coupling in-line skate means comprising another set of wheels to said sole portion for in-line skating, said step of coupling in-line skate means including the steps of:

providing a plurality of axles coupled to said sole portion and arranged in tandem along a longitudinal axis substantially bisecting said sole portion;

providing in-line skate mounting means for securing each axle of said plurality of axles substantially perpendicular to said longitudinal axis of said sole portion; and providing means for rotatable coupling each wheel of said another set of wheels to a corresponding axle of said plurality of axles, said step of providing in-line skate mounting means including the steps of:

vertically coupling first member means to said sole portion for engaging an end of one of said plurality of axles; and vertically coupling second member means to said sole portion for engaging an opposite end of said one of said plurality of axles such that said one of said plurality of axles is suspended horizontally between said first and said second member means, further including the step of providing in-line skate positioning means for extending and retracting said in-line skate means in relation to said sole portion.

27. The method of claim 26 wherein said step of providing in-line skate positioning means includes the steps of:

rotatably coupling at least one horizontal member to each axle of said plurality of axles;

rotatably coupling an extended shaft portion connected to at least one vertical member to each of said first and said second member means; and providing locking means coupled to each of said first and said second member means and comprising a locking shaft for insertion into any one of a plurality of apertures in said at least one vertical member and for locking therein to hold said in-line skate means in any one of a plurality of configurations.

28. The method of claim 27 wherein said plurality of configurations comprises at least a first configuration whereby said another set of wheels is lower than said four wheels, a second configuration whereby said another set of wheels is level with said four wheels, and a third configuration whereby said another set of wheels is higher than said four wheels.

29. A shoe apparatus for skating comprising, in combination:

roller skate means consisting of only four roller skate wheels coupled to a sole portion of said shoe apparatus for roller skating only;

in-line skate means consisting of only in-line skate wheels narrower in width relative to said roller skate wheels coupled to said sole portion for in-line skating only; and means for permitting selection of at least one of said roller skate means and said in-line skate means for skating.

* * * * *